US006083077A

United States Patent [19]

McGinn

[11] Patent Number: 6,083,077

[45] Date of Patent: Jul. 4, 2000

[54] POP-UP TOY

[76] Inventor: Paul E. McGinn, 26 Herber Ave., Delmar, N.Y. 12054

[21] Appl. No.: 09/092,201

[22] Filed: Jun. 4, 1998

[51] Int. Cl.[7] ..... A63H 3/16; A63H 33/30; A63H 33/04

[52] U.S. Cl. ..... 446/309; 446/75; 446/491; 446/475; 446/61; 446/137; 446/101

[58] Field of Search ..... 221/61, 62, 63; 446/75, 491, 73, 475, 137, 138, 139, 71, 129, 310, 309, 308

[56] References Cited

U.S. PATENT DOCUMENTS

| | | | |
|---|---|---|---|
| D. 260,469 | 9/1981 | Blake . | |
| 1,434,930 | 11/1922 | Taylor . | |
| 1,648,199 | 11/1927 | Sargent . | |
| 2,121,246 | 6/1938 | Gordon . | |
| 3,227,283 | 1/1966 | Ahlman | 211/69 |
| 3,246,798 | 4/1966 | Stone | 221/63 |
| 3,296,737 | 1/1967 | Doyle et al. . | |
| 3,477,167 | 11/1969 | Ach . | |
| 3,484,105 | 12/1969 | Winston . | |
| 3,613,300 | 10/1971 | Sequin et al. . | |
| 4,138,034 | 2/1979 | McCarthy | 221/48 |
| 4,435,915 | 3/1984 | Zaruba et al. . | |
| 4,520,946 | 6/1985 | Gould | 221/63 |
| 4,638,921 | 1/1987 | Sigl | 221/1 |
| 4,684,036 | 8/1987 | Brewer | 221/61 |
| 4,789,369 | 12/1988 | Lyman . | |
| 4,822,314 | 4/1989 | O'Brian | 446/75 |
| 4,936,460 | 6/1990 | Meyer . | |
| 4,954,114 | 9/1990 | Kawashima . | |
| 4,997,105 | 3/1991 | Fischer . | |
| 5,186,464 | 2/1993 | Lamle . | |
| 5,333,781 | 8/1994 | Roccaforte . | |
| 5,356,032 | 10/1994 | Rhodes . | |
| 5,580,293 | 12/1996 | Sestak et al. . | |
| 5,601,472 | 2/1997 | Parker . | |
| 5,687,840 | 11/1997 | Sherman . | |
| 5,718,353 | 2/1998 | Kanfer | 221/63 |
| 5,720,617 | 2/1998 | Var | 434/247 |
| 5,798,159 | 8/1998 | Callahan | 221/63 |

*Primary Examiner*—Sam Rimell
*Assistant Examiner*—Kevin Hughes

[57] ABSTRACT

A pop-up toy including a housing for enclosing a plurality of interlocking elements. The housing includes an opening through which the series of interlocking elements may be individually extracted by a child. The opening in the housing is provided with a gripping mechanism for separating a leading interlocking element from an immediately following interlocking element as the leading interlocking element is extracted from the housing. After the leading interlocking element has been extracted from the housing, the immediately following interlocking element in the series of interlocking elements is positioned and held in place within the opening by the gripping mechanism for subsequent extraction.

29 Claims, 5 Drawing Sheets

POP-UP TOY

FIELD OF THE INVENTION

The present invention is in the field of toys and educational playthings. More particularly, the present invention provides a pop-up toy containing a plurality of interlocking elements which may be sequentially extracted from an opening in a housing of the pop-up toy.

BACKGROUND OF THE INVENTION

Toys and playthings involving the extraction of objects from a container are well known in the art. Typically, such toys are designed to allow a child to extract objects, such as blocks or balls, from a container in a serial or random sequence. However, few known toys are designed to allow for the sequential extraction and separation of interconnected objects from a container. For example, U.S. Pat. No. 5,720,617 discloses an educational toy wherein a plurality of discrete, flexible, fabric sheet elements are contained within a dispenser box. The individual sheet elements may be stacked flat, folded and stacked, or interleaved to allow for serial dispensing through an aperture in the top surface of the dispenser box. Unfortunately, this toy suffers from several disadvantages. First, after all of the sheet elements have been extracted from the dispenser box, they must by restacked/interleaved within the dispenser box. Second, this toy does not provide a mechanism for preventing more than one of the sheet elements from being simultaneously extracted from the dispensing box. As a result, a child may inadvertently remove more than one of the sheet elements at a time, requiring the dispenser box to be refilled more often. Finally, the toy does not require the interconnection of the sheet elements prior to placement within the dispenser box, thereby limiting the educational value and physical demands of the toy.

SUMMARY OF THE INVENTION

The present invention provides a pop-up toy containing a series of interlocking elements that may be sequentially extracted from an opening in a housing of the pop-up toy. The pop-up toy is designed to entertain, educate, and improve the motor skills of a child.

The pop-up toy of the present invention includes a housing for enclosing a plurality of interlocking elements. The housing includes an opening through which the series of interlocking elements may be individually extracted by a child. The opening in the housing is provided with a gripping mechanism for separating a leading interlocking element from an immediately following interlocking element as the leading interlocking element is extracted from the housing. After the leading interlocking element has been extracted from the housing, the immediately following interlocking element in the series of interlocking elements is positioned and held in place within the opening by the gripping mechanism for subsequent extraction.

As will become more apparent in the following detailed description of the present invention, the interlocking elements may be formed in a wide variety of shapes, sizes, and materials, and may employ many types of connecting mechanisms. For example, the interlocking elements may comprise hollow beads or other solid or hollow three dimensional objects having ball and socket connectors. Alternately, the interlocking elements may comprise cloth shapes or stuffed objects having hook and loop type fasteners. The interlocking elements may also be formed in the shape of, or include indicia representative of, animals, letters, numbers, clowns, sea life, and the like. The housing may also be formed in a wide variety of configurations and materials. For instance, the housing may have a generally cylindrical or spherical shape, may be formed to represent an object such as a circus tent, barn, or fish bowl, may be rotatably mounted on a base, or may be illuminated. Although specific embodiments of the present invention are described herein, it should be readily apparent that many other configurations of the housing, interlocking elements, and other aspects of the present invention may be used without departing from the intended scope of the present invention as set forth in the accompanying claims.

BRIEF DESCRIPTION OF THE DRAWINGS

The features of the present invention will best be understood from a detailed description of the invention and a preferred embodiment thereof selected for the purposes of illustration and shown in the accompanying drawings in which.

DETAILED DESCRIPTION OF THE INVENTION

Figure 1:
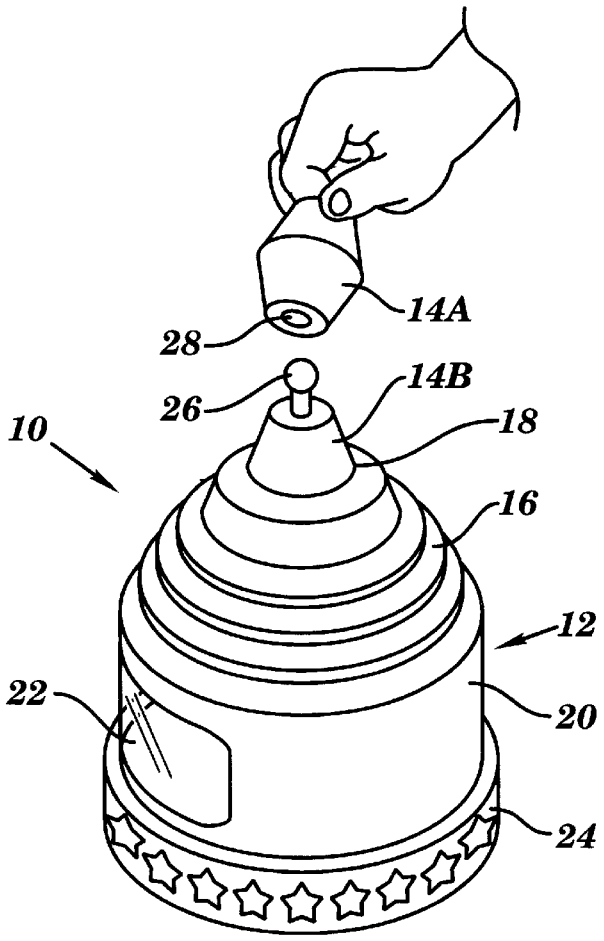
FIG. 1 is a perspective view of a first embodiment of a pop-up toy in accordance with the present invention, wherein a leading interlocking element has been extracted from the housing and separated from the next interlocking element, and wherein the next interlocking element is held within the opening in the housing.

The features and advantages of the present invention are illustrated in detail in the accompanying drawings, wherein like reference numerals refer to like elements throughout the drawings.

Referring to FIG. 1, there is illustrated a perspective view of a first embodiment of a pop-up toy 10 in accordance with the present invention. The pop-up toy 10 comprises a housing 12 containing a series of interlocking elements 14A, 14B, . . . , only two of which are shown in FIG. 1. The housing 12 includes a removable cover 16 having an opening 18, and a cylindrical side wall 20. A clear window 22 may be formed in the side wall 20 to allow a child to view the interlocking elements remaining in the housing 12. The housing 12 is preferably rotatably mounted to a base 24 in a manner known in the art to allow a child to rotate the housing 12 relative to the base 24. Alternately, the housing 12 may be fixedly attached to, or formed integrally with, the base 24.

The interlocking elements are preferably interconnected using complementary ball 26 and socket 28 connectors. In operation, a first interlocking element is joined to a second interlocking element by inserting a ball connector 26 formed on an end of the first interlocking element into a socket 28 formed in an end of the second interlocking element. Many other types of connecting systems, such as magnets, snaps, hook and loop fasteners, and the like, may also be used to interconnect the interlocking elements.

The opening 18 in the removable cover 16 is provided with a gripping mechanism 30 for separating a leading interlocking element 14A from an immediately following interlocking element 14B as the leading interlocking element 14A is extracted from the housing 12 by a child. In particular, as the leading interlocking element 14A is extracted from the housing 12, the immediately following interlocking element 14B is partially pulled out of the housing 12 through the opening 18, and is engaged and held in place within the opening 18 by the gripping mechanism 30. The force applied by the gripping mechanism 30 against the sides of the immediately following interlocking element 14B is sufficient to cause its ball connector 26 to separate from the corresponding socket connector 28 of the leading interlocking element 14A as the leading interlocking element 14A is pulled away from the housing 12. This allows a child to sequentially extract the interlocking elements, one at a time, from the housing 12.

Figure 2:
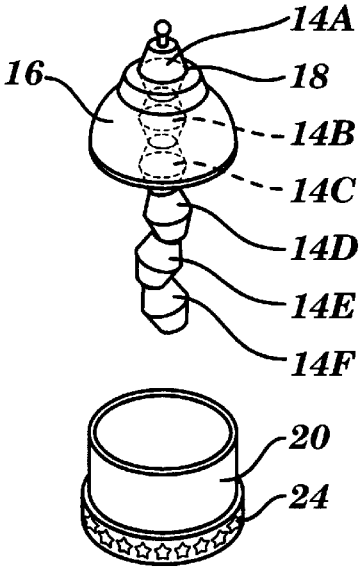
FIG. 2 is an exploded view of the pop-up toy of FIG. 1 illustrating the series of interlocking elements contained within the housing.

FIG. 2 is an exploded view of the pop-up toy 10, showing the removable cover 16 pulled away from the cylindrical side wall 20. A series of the interlocking elements 14A, 14B, 14C, 14D, 14E, and 14F are contained within the housing 12, with interlocking element 14A partially extending out of, and held within, the opening 18. The interlocking element 14A is held within the opening 18, ready for extraction, by the gripping mechanism 30.

FIG. 2 also illustrates a method for resetting the pop-up toy after some or all of the interlocking elements have been extracted from the housing 12. First, the interlocking elements are reconnected using the ball 26 and socket 28 connectors. Second, the leading interlocking element 14A is partially inserted through the opening 18. Finally, the series of interlocking elements are placed within the housing 12, and the removable cover 16 is replaced. The leading interlocking element 14A is now available for extraction. As presented in greater detail below, the interlocking elements may be joined together in a random, predetermined, or child selected order prior to being placed within any of the pop-up toys of the present invention.

Figure 3:
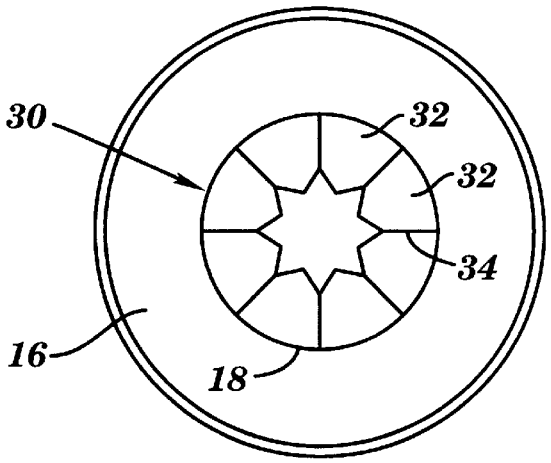
FIG. 3 illustrates a first embodiment of a gripping mechanism in accordance with the present invention.

FIG. 3 illustrates a first embodiment of a gripping mechanism 30, formed within the opening 18 in the removable cover 16, in accordance with the present invention. The gripping mechanism 30 includes a plurality of flexible gripping teeth 32 arranged circumferentially about the opening 18. The flexible gripping teeth 32 extend radially into the opening 18, and are separated by slits 34, allowing each flexible gripping tooth 32 to independently flex and engage an area of the interlocking element as it is pulled into the opening 18. Of course, many other types of gripping mechanisms may be used in the present invention to engage and cause the separation of the interlocking elements.

Figure 4:
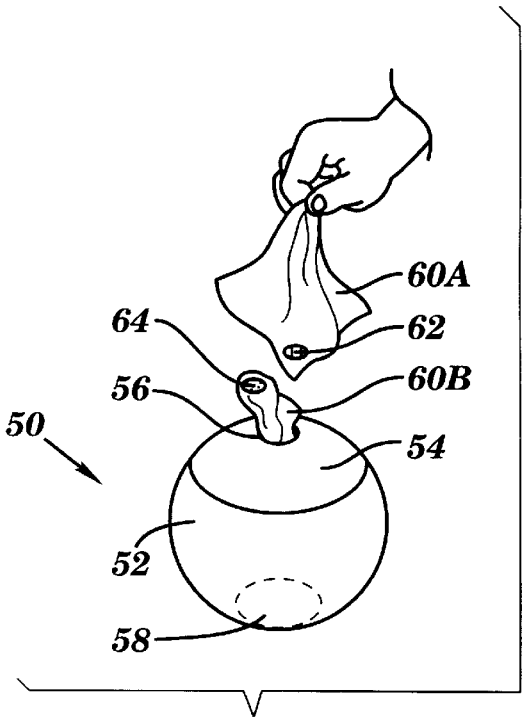
FIG. 4 is a perspective view of another embodiment of a pop-up toy in accordance with the present invention, wherein a series of interlocked, flexible sheet elements are enclosed within a sphere shaped housing.

A perspective view of another embodiment of a pop-up toy 50 is illustrated in FIG. 4. The pop-up toy 50 includes a spherical housing 52 with a removable cover 54. An opening 56 is provided in the removable cover 54 to allow for the extraction of the interlocking elements from spherical housing 52. The spherical housing 52 includes a weighted bottom 58 which causes the pop-up toy 50 to return to an upright position after it has been tilted, rolled, etc., by a child.

Preferably, a plurality of interlocking, flexible sheet elements 60A, 60B, . . . , are used in conjunction with the pop-up toy 50. However, other types of interlocking elements may also be used with the pop-up toy 50. The interlocking, flexible sheet elements are preferably interconnected using hook 62 and loop 64 type fasteners. Again, many other types of connecting systems, such as magnets and the like, may also be used to interconnect the flexible sheet elements. As shown in greater detail in FIG. 6, a hook fastener 62 and a loop fastener 64 are sewn, glued, or otherwise attached to each of the flexible sheet elements.

The opening 56 in the removable cover 54 is provided with a gripping mechanism 66 (FIG. 7) for separating a leading flexible sheet element 60A from an immediately following flexible sheet element 60B as the leading flexible sheet element 60A is extracted from the spherical housing 52 by a child. As shown in FIG. 4, after extraction of the leading flexible sheet element 60A, the immediately following flexible sheet element 60B extends partially through the opening 56, and is engaged and held in place within the opening 56 by the gripping mechanism 66. The force applied by the gripping mechanism 66 against the immediately following flexible sheet element 60B is sufficient to cause its hook fastener 62 to detach from the corresponding loop fastener 64 on the leading flexible sheet element 60A as the leading flexible sheet element 60A is pulled away from the spherical housing 52.

Figure 5:
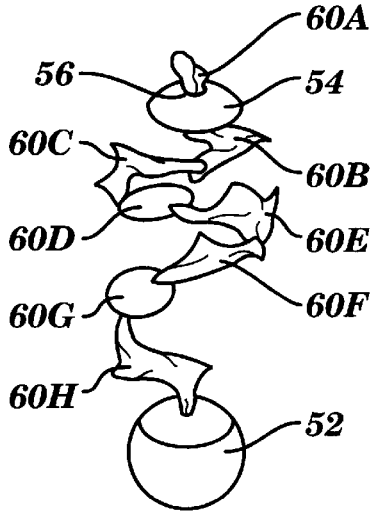
FIG. 5 is an exploded view of the pop-up toy of FIG. 4.
Figure 6:
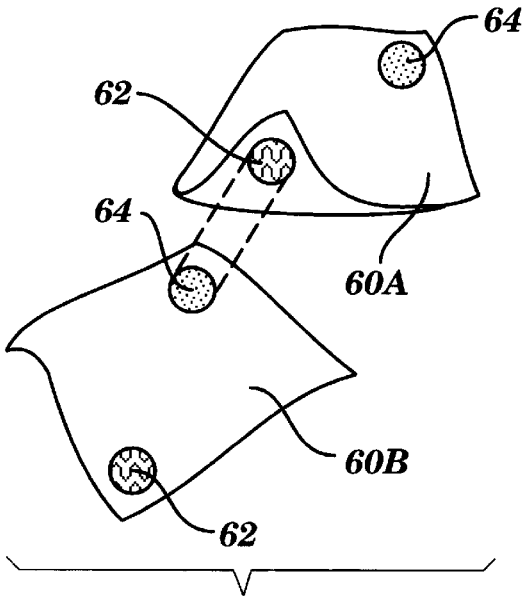
FIG. 6 illustrates the interconnection of the flexible sheet elements of FIG. 4 using hook and loop type fasteners.

FIG. 5 is an exploded view of the pop-up toy 50, showing the removable cover 54 pulled away from the spherical housing 52. A series of the interlocking flexible sheet elements 60A, 60B, . . . , and 60H are contained within the pop-up toy 50, with a flexible sheet element 60A partially extending out of, and held within, the opening 56 by the gripping mechanism 66. FIG. 6 also illustrates a method for resetting the pop-up toy 50 after some or all of the flexible sheet elements have been extracted from the spherical housing 52.

Figure 7:
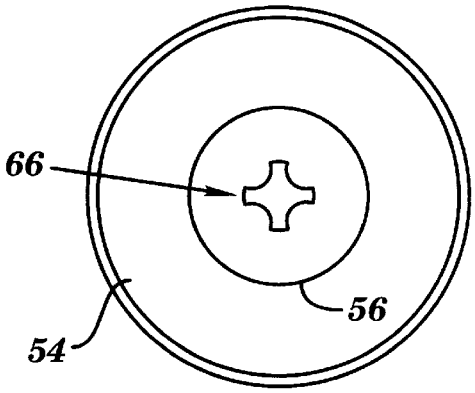
FIG. 7 illustrates a second embodiment of a gripping mechanism in accordance with the present invention.

As shown in FIG. 7, the gripping mechanism 66 is implemented by forming the opening 56 in a fluted configuration. In operation, the opening 56 is designed such that the force required to pull a leading flexible sheet element 60A through the opening 56 is greater than the force required to separate the leading flexible sheet element 60A from a following flexible sheet element 60B (FIG. 4). This ensures that the plurality of interconnected flexible sheet elements are dispensed one at a time from the pop-up toy 50.

Figure 8:
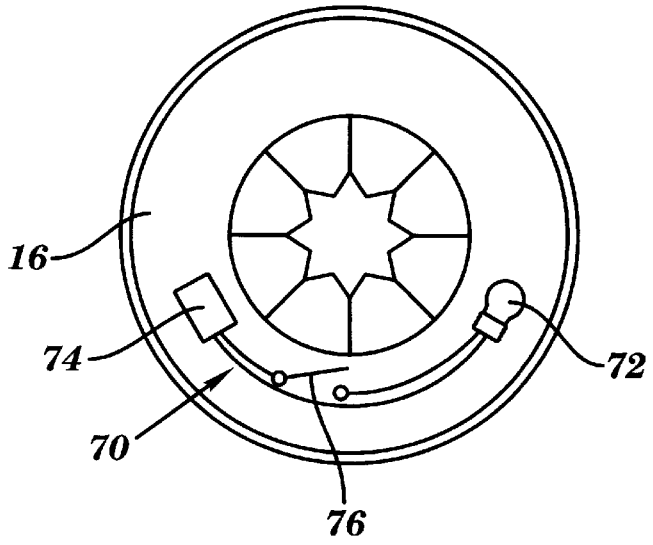
FIG. 8 is an interior view of another embodiment of a pop-up toy in accordance with the present invention, wherein an illumination system is provided to illuminate the interlocking elements as they are extracted through the opening in the housing.

The present invention may include an illumination system for illuminating an interlocking element located in the opening of the pop-up toy. Such an illumination system 70 is illustrated in FIG. 8, wherein the illumination system 70 is mounted to the underside of the removable cover 16 of the pop-up toy 10 (see also FIG. 1). The illumination system 70 includes a light source 72, such as an incandescent light bulb, a battery power supply 74, and an actuating switch 76.

Figure 9:
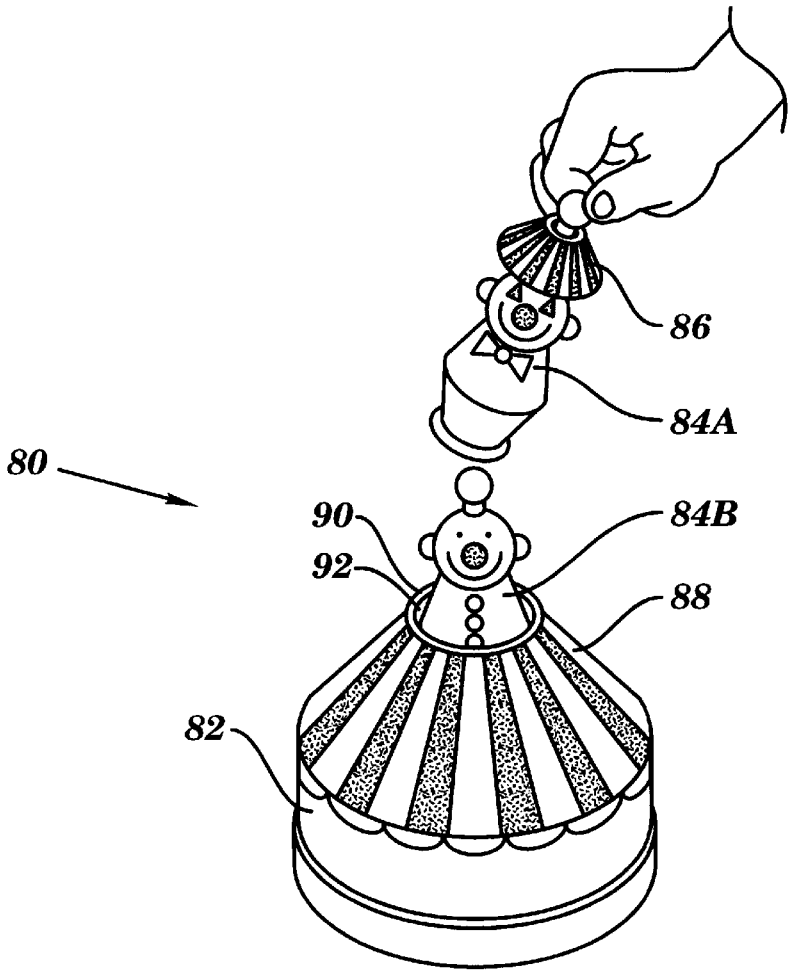
FIG. 9 is the perspective view of another embodiment of a pop-up toy in accordance with the present invention, wherein housing resembles a circus tent, and wherein the interlocking elements represent circus clowns.

Another embodiment of a pop-up toy 80 in accordance with the present invention, having a housing 82 in the shape of a circus tent, is illustrated in FIG. 9. In this embodiment, the interlocking elements 84A, 84B, . . . , are formed in the shape of circus clowns. Furthermore, one of the clown-shaped interlocking elements includes a hat 86 which serves as a tent top for the removable cover 88 of the pop-up toy 80. A gripping mechanism 90 formed in an opening 92 in the removable cover 88 separates the clown-shaped interlocking elements 84 as they are extracted from the pop-up toy 80.

Figure 10:
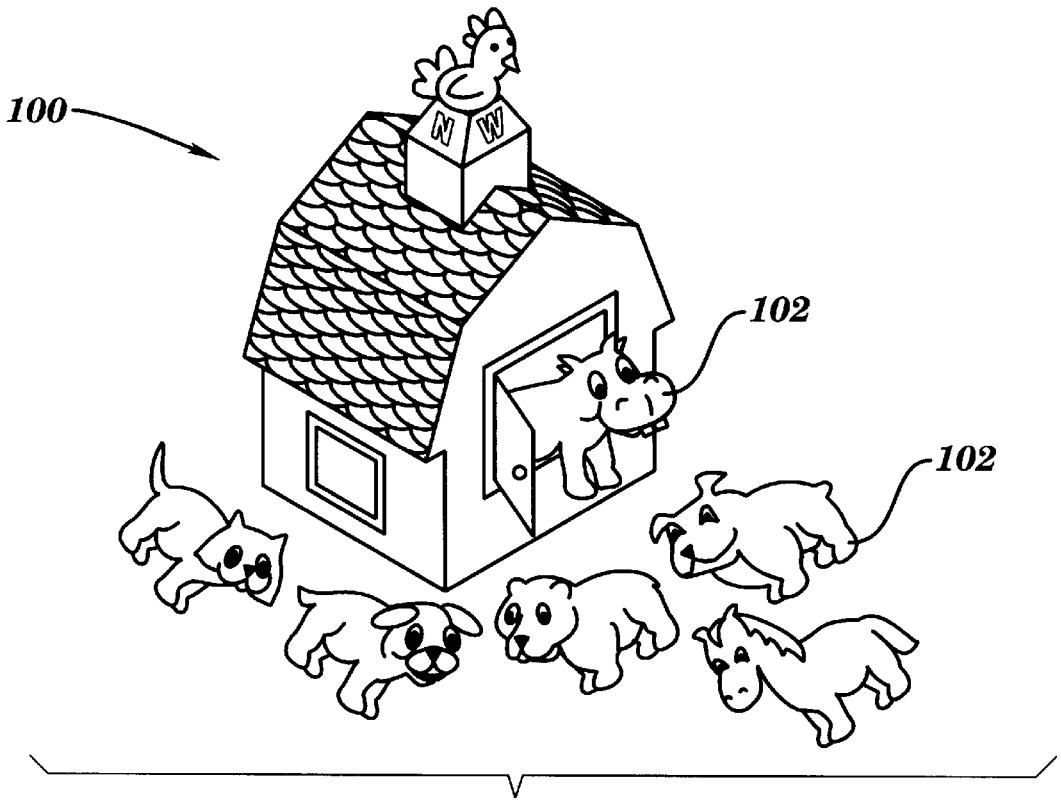
FIG. 10 is a perspective view of another embodiment of a pop-up toy in accordance with the present invention, illustrating a housing that embodies a farmer's barn, and interlocking elements formed in the shape of farm animals.
Figure 11:
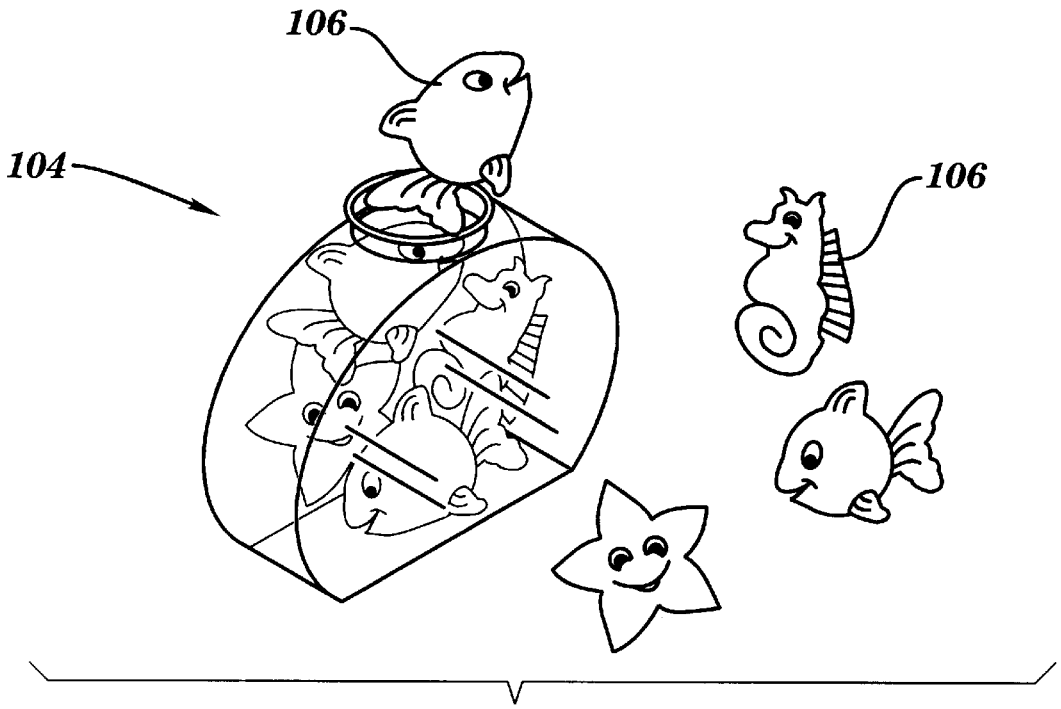
FIG. 11 is a perspective view of another embodiment of a pop-up toy in accordance with the present invention, illustrating a housing in the shape of a fish tank, and interlocking elements in the form of sea creatures.

Additional possible embodiments of the present invention are illustrated in FIGS. 10 and 11. In FIG. 10, for example, a pop-up toy 100 may be formed in the shape of a barn, with the interlocking elements 102 resembling a variety of farm animals. Analogously, as shown in FIG. 11, a pop-up toy 104 may be formed in the shape of a fish bowl, with the interlocking elements 106 resembling a variety of sea creatures. Each of the pop-up toys 100, 104 includes an opening/gripping mechanism for the extraction and separation of the interlocking elements.

Figure 12:
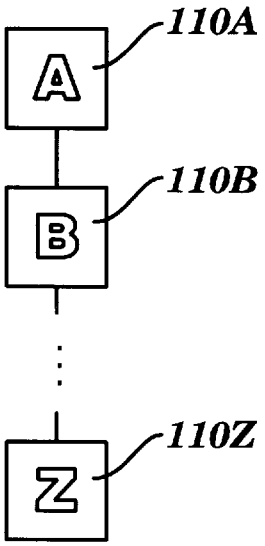
FIG. 12 illustrates a series of interlocking elements, having letters printed or otherwise formed thereon, arranged in alphabetical order.
Figure 13:
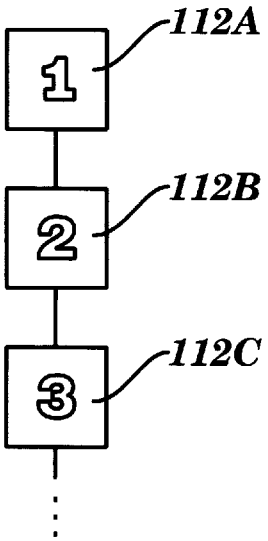
FIG. 13 illustrates a series of interlocking elements, having numbers printed or otherwise formed thereon, arranged in numerical order.
Figure 14:
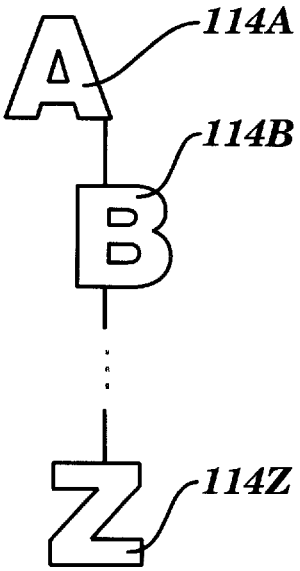
FIG. 14 illustrates a series of letter-shaped interlocking elements connected together in alphabetic order.
Figure 15:
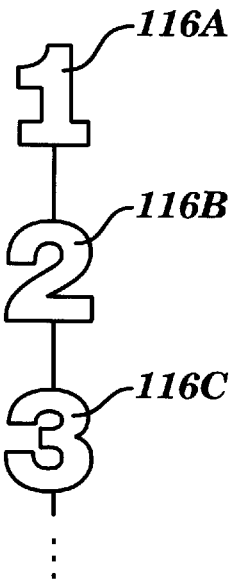
FIG. 15 illustrates a series of number-shaped interlocking elements connected together in numerical order.

A plurality of interlocking elements 110A, 110B, . . . , 110Z, representative of the letters of the alphabet, are illustrated in FIG. 12. Similarly, a plurality of interlocking elements 112A, 112B, . . . , representative of a sequence of numbers are illustrated in FIG. 13. These interlocking elements may be interconnected in a predetermined sequence (e.g., in alphabetic or numerical order) before being placed inside the housing. When a child extracts the elements from a pop-up toy, the interlocking elements are presented to the child in the predetermined sequence, thereby educating the child. Additionally, after individually extracting the interlocking elements from the pop-up toy, the child can reconnect the loose interlocking elements in the predetermined sequence before once again placing the chain of interlocked elements back into the pop-up toy. As illustrated in FIGS. 14 and 15, the interlocking elements 114A, 114B, . . . , 114Z and 116A, 116B, . . . , may also be formed in the shape of letters and numbers, respectively.

The foregoing description of the present invention has been presented for purposes of illustration and description. It is not intended to be exhaustive or to limit the invention to the precise form disclosed, and many modifications and variations are possible in light of the above teaching. Such modifications and variations that may be apparent to a person skilled in the art are intended to be included within the scope of this invention as defined by the accompanying claims.

I claim:

1. A toy comprising:

a housing;

an opening in the housing;

a plurality of interlocking elements located within the housing; and a gripping mechanism for sequentially dispensing the plurality of interlocking elements through the opening in the housing, wherein each of the interlocking elements includes a plurality of complementary ball and socket type connectors for coupling the interlocking elements together.

2. The toy according to claim 1, wherein the housing includes a removable cover portion for enabling the refilling of the housing with the plurality of interlocking elements.

3. The toy according to claim 1, further including a base portion for rotatably supporting the housing.

4. The toy according to claim 1, wherein the housing further includes a transparent window.

5. The toy according to claim 1, wherein any of the interlocking elements is attachable to any other of the plurality of interlocking elements.

6. The toy according to claim 1, wherein the gripping mechanism is configured to engage and hold a following one of the interlocking elements as a leading one of the interlocking elements is extracted through the opening in the housing, such that the leading interlocking element separates from the following interlocking element.

7. The toy according to claim 6, wherein the following interlocking element is held by the gripping mechanism such that it partially extends through the opening in the housing.

8. The toy according to claim 6, wherein the gripping mechanism is configured to apply a force against the following interlocking element greater than a force required to separate the leading interlocking element from the following interlocking element.

9. The toy according to claim 1, wherein the gripping mechanism comprises a plurality of flexible gripping teeth arranged about the opening in the housing.

10. The toy according to claim 1, further including an illumination system for illuminating the interlocking elements as they are sequentially extracted from the housing.

11. The toy according to claim 1, wherein the housing has a substantially spherical configuration, and wherein a base of the housing is weighted to ensure that the housing returns to an upright orientation.

12. The toy according to claim 1, wherein at least one of the interlocking elements includes a cover portion configured to seal the opening in the housing.

13. The toy according to claim 1, wherein the interlocking elements are shaped in the form of letters, numbers, animals, clowns, or sea life.

14. The toy according to claim 1, wherein the interlocking elements include indicia representative of letters or numbers thereon.

15. A toy comprising:

a housing having an opening therein;

a plurality of interlocking elements located within the housing; and a gripping mechanism for separating a leading one of the interlocking elements from an immediately following one of the interlocking elements as the leading interlocking element is extracted through the opening in the housing, wherein each of the interlocking elements includes a plurality of complementary ball and socket type connectors for coupling the interlocking elements together.

16. The toy according to claim 15, wherein the gripping mechanism is configured to position the immediately following interlocking element partially through the opening in the housing for subsequent extraction.

17. The toy according to claim 15, wherein the gripping mechanism is configured to apply a force against the immediately following interlocking element greater than a force required to separate the leading interlocking element from the immediately following interlocking element.

18. A toy comprising:

a housing;

an opening in the housing;

a plurality of interlocking elements located within the housing;

a gripping mechanism for sequentially dispensing the plurality of interlocking elements through the opening in the housing; and an illumination system for illuminating the interlocking elements as they are sequentially extracted from the housing.

19. The toy according to claim 18, wherein the interlocking elements include a plurality of complementary connectors for coupling the interlocking elements together.

20. The toy according to claim 19, wherein the complementary connectors include hook and loop type fasteners.

21. A toy comprising:

a housing;

an opening in the housing;

a plurality of interlocking elements located within the housing;

a gripping mechanism for sequentially dispensing the plurality of interlocking elements through the opening in the housing;

wherein the housing has a substantially spherical configuration, and wherein a base of the housing is weighted to ensure that the housing returns to an upright orientation.

22. The toy according to claim 21, wherein the interlocking elements include a plurality of complementary connectors for coupling the interlocking elements together.

23. The toy according to claim 22, wherein the complementary connectors include hook and loop type fasteners.

24. A toy comprising:

a housing;

an opening in the housing;

a plurality of interlocking elements located within the housing;

a gripping mechanism for sequentially dispensing the plurality of interlocking elements through the opening in the housing; and wherein the interlocking elements are shaped in the form of letters, numbers, animals, clowns, or sea life.

25. The toy according to claim 24, wherein the interlocking elements include a plurality of complementary connectors for coupling the interlocking elements together.

26. The toy according to claim 25, wherein the complementary connectors include hook and loop type fasteners.

27. A toy comprising:

a housing;

an opening in the housing;

a plurality of interlocking elements located within the housing;

a gripping mechanism for sequentially dispensing the plurality of interlocking elements through the opening in the housing; and wherein the interlocking elements include indicia representative of letters or numbers thereon.

28. The toy according to claim 27, wherein the interlocking elements include a plurality of complementary connectors for coupling the interlocking elements together.

29. The toy according to claim 28, wherein the complementary connectors include hook and loop type fasteners.

* * * * *